US011261405B2

(12) United States Patent
De Jonge

(10) Patent No.: US 11,261,405 B2
(45) Date of Patent: Mar. 1, 2022

(54) AQUEOUS CLEANING COMPOSITION COMPRISING AN ETHOXYLATED ALCOHOL/ETHOXYLATED CATIONIC SURFACTANT MIXTURE

(71) Applicant: GUARD IT SOLUTIONS PTY LTD, Kew East (AU)

(72) Inventor: Richard De Jonge, Patterson Lakes (AU)

(73) Assignee: GUARD IT SOLUTIONS PTY LTD, Thomastown (AU)

( * ) Notice: Subject to any disclaimer, the term of this patent is extended or adjusted under 35 U.S.C. 154(b) by 118 days.

(21) Appl. No.: 16/305,569

(22) PCT Filed: May 30, 2017

(86) PCT No.: PCT/AU2017/050515
§ 371 (c)(1),
(2) Date: Nov. 29, 2018

(87) PCT Pub. No.: WO2017/205915
PCT Pub. Date: Dec. 7, 2017

(65) Prior Publication Data

US 2020/0325417 A1 Oct. 15, 2020

(30) Foreign Application Priority Data

May 31, 2016 (AU) ..... 2016902087

(51) Int. Cl.

| | |
|---|---|
| ***C11D 1/62*** | (2006.01) |
| ***C11D 3/12*** | (2006.01) |
| ***C11D 1/50*** | (2006.01) |
| ***C11D 1/66*** | (2006.01) |
| ***C11D 1/722*** | (2006.01) |
| ***C11D 1/835*** | (2006.01) |
| ***C11D 3/20*** | (2006.01) |
| ***C11D 11/00*** | (2006.01) |
| ***C11D 17/00*** | (2006.01) |

(52) U.S. Cl.
CPC ..... *C11D 3/1246* (2013.01); *C11D 1/50* (2013.01); *C11D 1/62* (2013.01); *C11D 1/667* (2013.01); *C11D 1/722* (2013.01); *C11D 1/835* (2013.01); *C11D 3/201* (2013.01); *C11D 11/0052* (2013.01); *C11D 11/0064* (2013.01); *C11D 17/0008* (2013.01)

(58) Field of Classification Search
CPC .. C11D 1/62; C11D 1/72; C11D 3/124; C11D 3/2068; C11D 7/14; C11D 7/263; C11D 7/50; C11D 11/0023
See application file for complete search history.

(56) References Cited

U.S. PATENT DOCUMENTS

| | | | | |
|---|---|---|---|---|
| 4,222,905 A * | 9/1980 | Cockrell, Jr. | ..... | C11D 1/38 510/295 |
| 6,440,910 B1 * | 8/2002 | Smith | ..... | C11D 1/72 510/130 |
| 2013/0111675 A1 * | 5/2013 | Soontravanich | ..... | D06L 1/20 8/137 |

* cited by examiner

*Primary Examiner* — Charles I Boyer
(74) *Attorney, Agent, or Firm* — K&L Gates LLP; Louis C. Cullman; Benjamin D. Heuberger

(57) ABSTRACT

The present invention broadly relates to aqueous cleaning compositions and the use thereof in cleaning soiled surfaces.

16 Claims, 7 Drawing Sheets

AQUEOUS CLEANING COMPOSITION COMPRISING AN ETHOXYLATED ALCOHOL/ETHOXYLATED CATIONIC SURFACTANT MIXTURE

The present application is a national phase entry of PCT/AU2017/050515 filed May 30, 2017, which claims the benefit of Australian Application No. AU2016902087 filed May 31, 2016, the entire disclosures each of which are incorporated by reference herein.

FIELD OF THE INVENTION

The present invention broadly relates to aqueous cleaning compositions and the use thereof in cleaning soiled surfaces.

BACKGROUND OF THE INVENTION

The use of cleaning compositions is ubiquitous across a wide range of industries. However, many traditional cleaning products often include components that damage equipment and/or contaminate waste water.

Against this background, the present inventors have developed cleaning compositions that are highly effective, yet readily biodegradable and non-toxic.

SUMMARY OF THE INVENTION

In a first aspect the present invention provides a water-based cleaning composition comprising:

(i) a silicate;

(ii) an ethoxylated alcohol;

(iii) a quaternary fatty amine ethoxylate; and (iv) a urea salt.

The silicate may be present in the composition in an amount between about 0.05% and about 10% by weight.

The ethoxylated alcohol may be present in the composition in an amount between about 0.5% and about 20% by weight.

The quaternary fatty amine ethoxylate may be present in the composition in an amount between about 0.1% and about 20% by weight.

The urea salt may be present in the composition in an amount between about 1% and about 60% by weight.

The composition may comprise water in an amount between about 30% and about 70% by weight, or in amount between about 45% and about 70% by weight.

The silicate may be an alkali metal silicate. In some embodiments the silicate is a metasilicate.

The ethoxylated alcohol may be a $C_9$-$C_{11}$ ethoxylated alcohol.

The $C_9$-$C_{11}$ ethoxylated alcohol may have an average of about 2 to 10 moles of ethylene oxide per mole of alcohol, or an average of about 4 to 8 moles of ethylene oxide per mole of alcohol.

The quaternary fatty amine ethoxylate may have the following general formula (I):

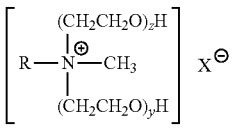

(I)

wherein:

R is a $C_4$-$C_{24}$ alkyl group;

z and y are independently selected from an integer between 1 and 20; and

X is a counter ion.

The composition may further comprise butoxyethanol, for example 2-butoxyethanol.

The butoxyethanol may be present in the composition in an amount between about 0.05% and 10% by weight.

The composition may further comprise akyl esters of one or more soybean oil fatty acids.

The alkyl esters of the one or more soybean oil fatty acids may be $C_1$-$C_{20}$ alkyl esters or mixtures thereof, $C_1$-$C_{10}$ alkyl esters or mixtures thereof, $C_1$-$C_4$ alkyl esters or mixtures thereof, or methyl esters.

The alkyl esters of the one or more soybean oil fatty acids may be present in the composition in an amount between about 0.01% and 3% by weight.

In a second aspect the present invention provides a method for cleaning a soiled surface comprising: contacting the soiled surface with the composition of the first aspect, and rinsing the surface with water.

The method may further comprise agitating the surface to which the composition has been applied.

The surface may be soiled with one or more of oil, grease, grime, dirt, bacteria, mould, mildue, carbon residue, cement residue, lichen, funghi (such as black spot) and organic stains.

Definitions

The following are some definitions that may be helpful in understanding the description of the present invention. These are intended as general definitions and should in no way limit the scope of the present invention to those terms alone, but are put forth for a better understanding of the following description.

Throughout this specification, unless the context requires otherwise, the word "comprise", or variations such as "comprises" or "comprising", will be understood to imply the inclusion of a stated element, integer or step, or group of elements, integers or steps, but not the exclusion of any other element, integer or step, or group of elements, integers or steps. Thus, in the context of this specification, the term "comprising" means "including principally, but not necessarily solely".

In the context of this specification the term "about" is understood to refer to a range of numbers that a person of skill in the art would consider equivalent to the recited value in the context of achieving the same function or result.

In the context of this specification the terms "a" and "an" are used herein to refer to one or to more than one (i.e to at least one) of the grammatical object of the article. By way of example, "an element" means one element or more than one element.

In the context of this specification the term "quaternary fatty amine ethoxylate" refers to a quaternary ammonium compound that is ethoxylated one or more times and further comprises a hydrocarbon chain (fatty alkyl chain) of at least about 4, 5, 6, 7, 8 or more carbons.

In the context of this specification, the term "alkyl" is taken to mean straight chain or branched chain monovalent saturated hydrocarbon groups having the recited number of carbon atoms. Examples of alkyl groups include, but are not limited to, methyl, ethyl, 1-propyl, isopropyl, 1-butyl, 2-butyl, isobutyl, tert-butyl, amyl, 1,2-dimethylpropyl, 1,1-dimethylpropyl, pentyl, isopentyl, hexyl, 4-methylpentyl, 1-methylpentyl, 2-methylpentyl, 3-methylpentyl, 2,2-dimethylbutyl, 3,3-dimethylbutyl, 1,2-dimethylbutyl, 1,3-dimethylbutyl, 1,2,2-trimethylpropyl, 1,1,2-trimethylpropyl, 2-ethylpentyl, 3-ethylpentyl, heptyl, 1-methylhexyl, 2,2-dimethylpentyl, 3,3-dimethylpentyl, 4,4-dimethylpentyl, 1,2-dimethylpentyl, 1,3-dimethylpentyl, 1,4-dimethylpentyl, 1,2,3-trimethylbutyl, 1,1,2-trimethylbutyl, 1,1,3-trimethylbutyl, 5-methylheptyl, 1-methylheptyl, octyl, nonyl, dodecyl and the like.

In the context of the present specification, the term "water-based" means that water is a, or the, major component of the composition.

In the context of the present specification, the term "substantially free" is understood to mean less than about 0.01%, or less than about 0.005%, or less than about 0.001%, or less than about 0.0001% of the recited component by weight in the composition.

In the context of the present specification, the term "readily biodegradable" means that 60% to 70% of the composition to which it refers is able to be degraded or broken down in a natural environmental within 28 days.

DETAILED DESCRIPTION OF THE INVENTION

Figure 1:
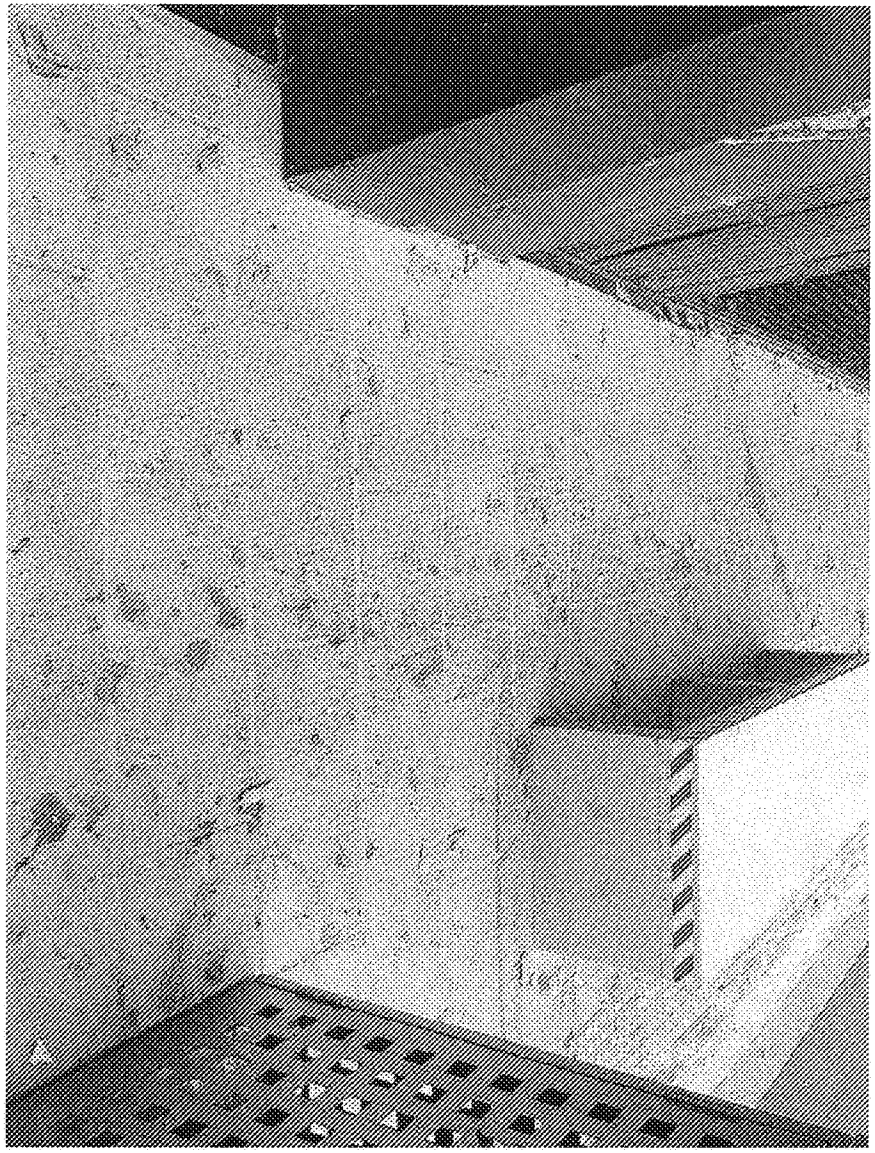
FIGS. 1 to 7 show before and after photos of pavers cleaned with a composition in accordance with one embodiment of the invention.
Figure 2:
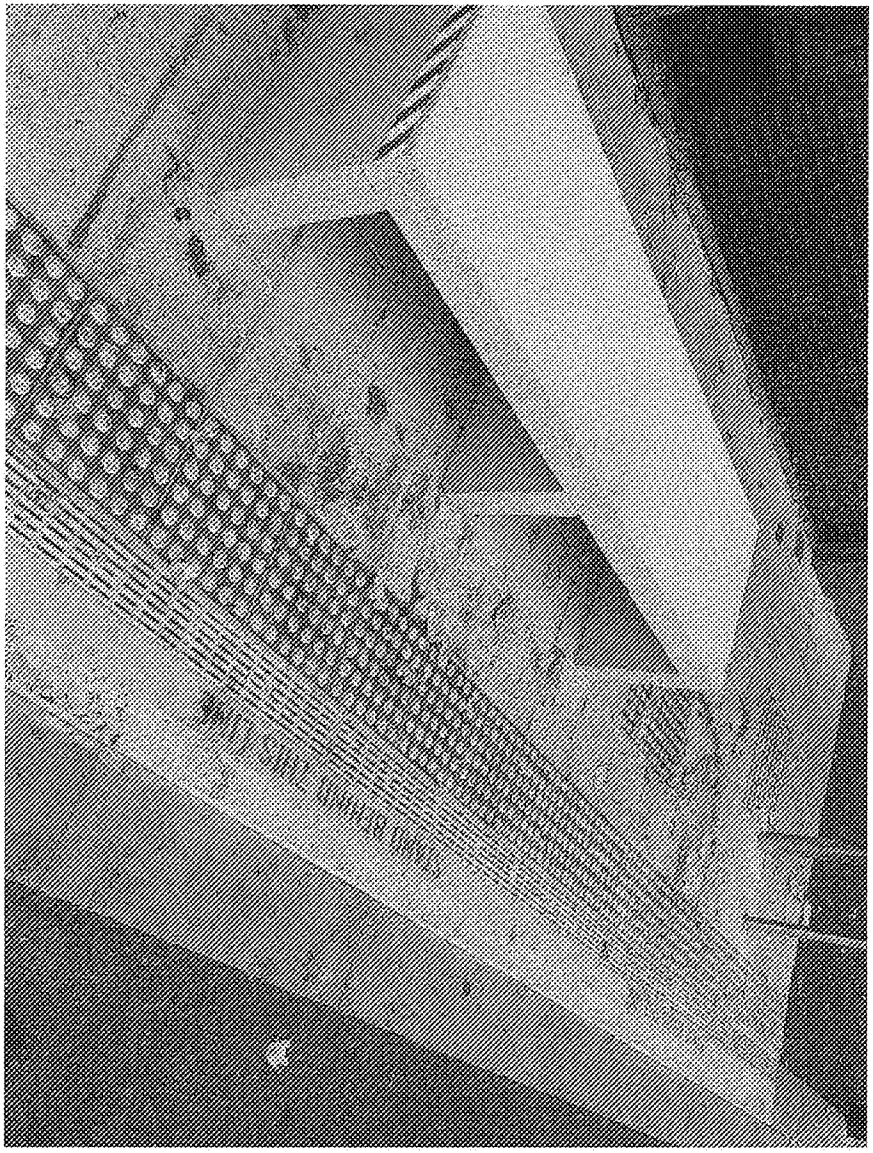
Figure 3:
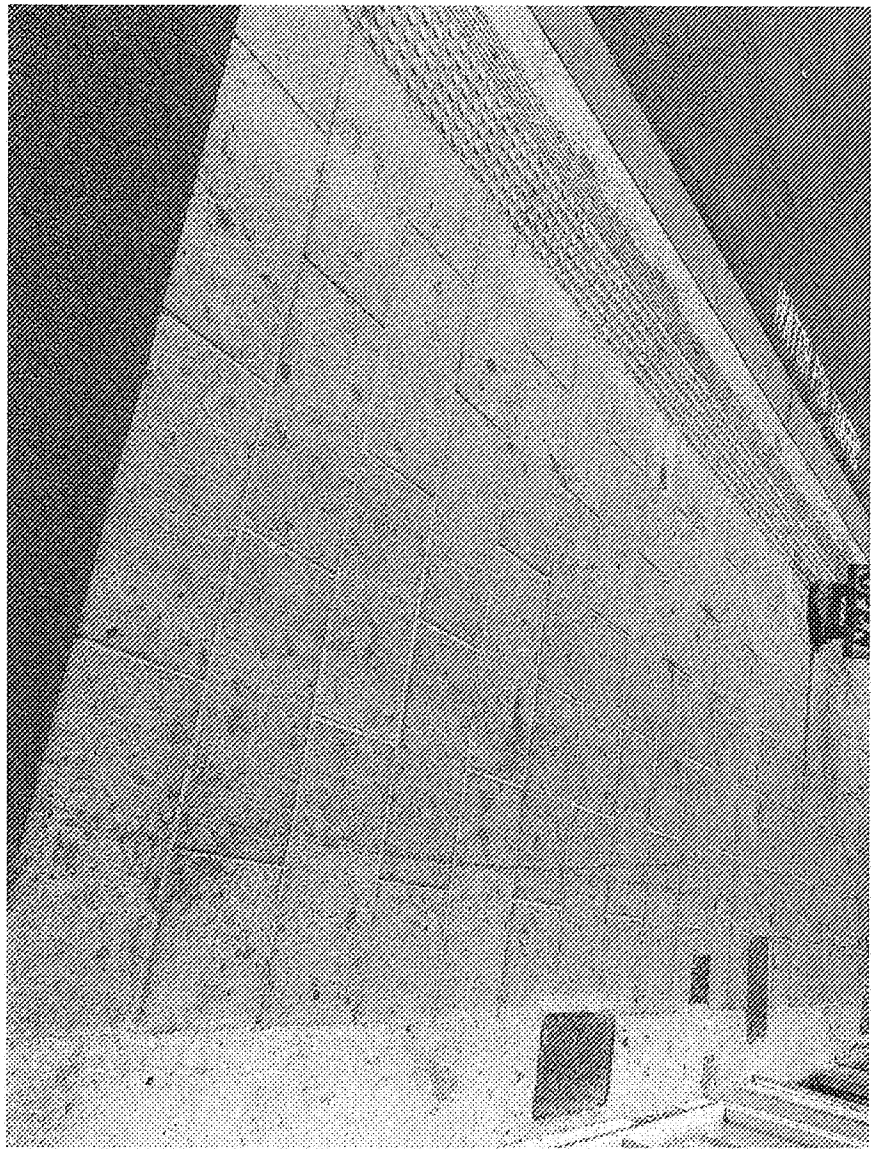
Figure 4:
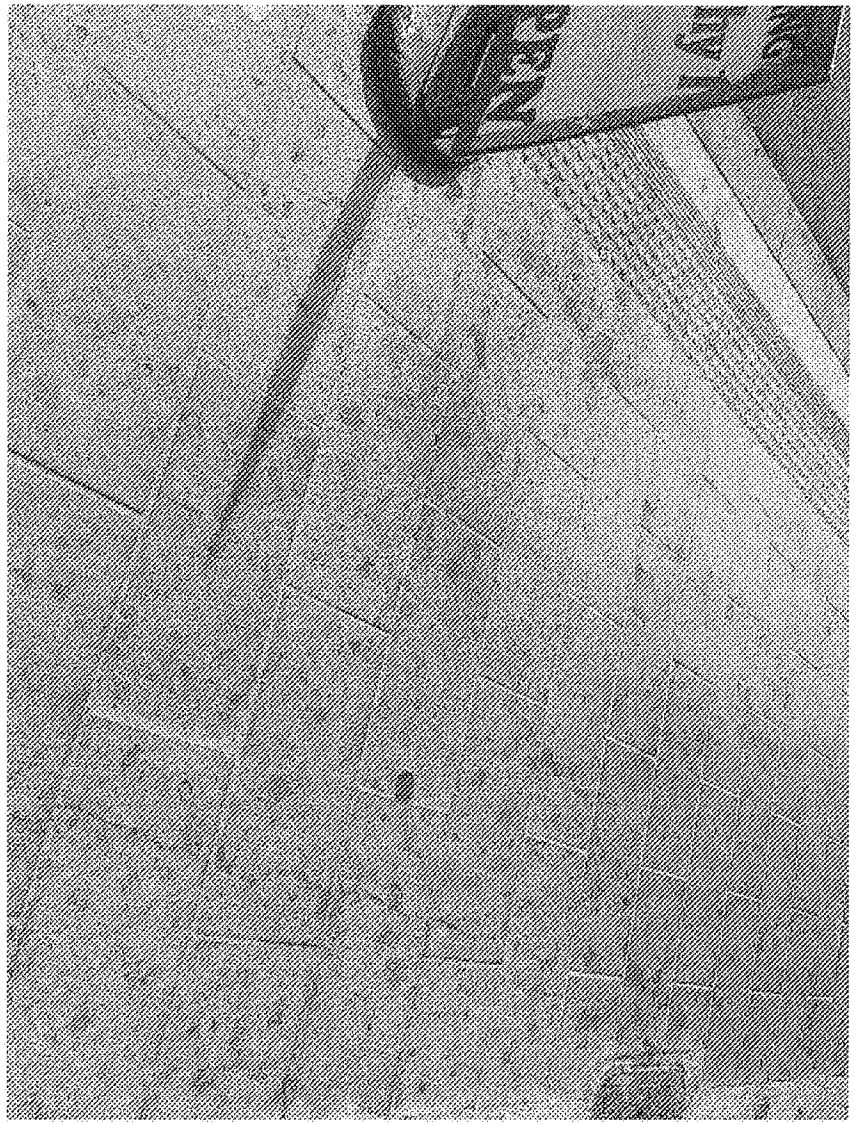

In one aspect the present invention provides a water-based cleaning composition comprising:

(i) a silicate;

(ii) an ethoxylated alcohol;

(iii) a quaternary fatty amine ethoxylate; and (iv) a urea salt.

The compositions find use in cleaning, and more particularly in removing oil, grease, grime, dirt, bacteria, mould, mildue, carbon residue, cement residue, lichen, funghi (such as black spot), organic stains and the like, from surfaces. Typically the surface is an external surface and may be porous or non-porous. Non-limiting examples of surfaces include: brick, rendered surfaces, terracotta, bluestone, timber, metal, rubber, colorbond, concrete, sandstone and other masonry surfaces, stone block work either natural or man made. In some embodiments the surface is concrete, pavers or tiles.

The compositions are non-toxic, non-flammable, non-irritant, non-carcinogenic, readily biodegradable and free, or substantially free, of caustic compounds, hydrochloric acid, hydrofluoric acid, sulfuric acid, nitric acid, chlorinated solvents and phosphates.

In some embodiments the silicate is an alkali metal silicate. In alternative embodiments the silicate is a metasilicate, for example sodium metasilicate, barium metasilicate or calcium metasilicate.

The silicate may be present in the composition in an amount between about 0.05% and about 10% by weight, or in an amount between about 0.05% and about 5% by weight, or in an amount between about 0.05% and about 3% by weight, or in an amount between about 0.1% and about 3% by weight.

Typically the ethoxylated alcohol is a $C_9$-$C_{11}$ ethoxylated alcohol. In some embodiments the $C_9$-$C_{11}$ ethoxylated alcohol has an average of about 2 to 10 moles of ethylene oxide per mole of alcohol. In other embodiments the $C_9$-$C_{11}$ ethoxylated alcohol has an average of about 3 to 9 moles of ethylene oxide per mole of alcohol. In yet further embodiments the $C_9$-$C_{11}$ ethoxylated alcohol has an average of about 4 to 8 moles of ethylene oxide oxide per mole of alcohol.

$C_9$-$C_{11}$ ethoxylated alcohols may be prepared from the corresponding primary alcohols by reaction with ethylene oxide utilising methods well known to those skilled in the art. $C_9$-$C_{11}$ ethoxylated alcohols are also commercially available from a range of sources under the following trade names: Berol® 260, Berol 260®, C9-11 Pareth-6, Tomadol 91-6 and Rhodasurf91-6, to name just a few.

The ethoxylated alcohol may be present in the composition in an amount between about 0.5% and about 25% by weight, or in an amount between about 0.5% and about 20% by weight, or in an amount between about 0.5% and about 15% by weight.

In some embodiments, the quaternary fatty amine ethoxylate has the following general formula (I):

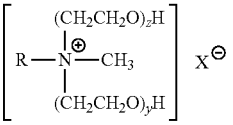

(I)

wherein:

R is a $C_4$-$C_{24}$ alkyl group;

z and y are independently selected from an integer between 1 and 20; and

X is a counter ion, for example chloride, bromide, methosulfate and the like.

In alternative embodiments R is a $C_8$-$C_{24}$ alkyl group and z and y are independently selected from an integer between 1 and 10. In still a further embodiment R is a $C_{10}$-$C_{20}$ alkyl group or a $C_{12}$-$C_{18}$ alkyl group and z and y are independently selected from an integer between 1 and 10, 1 and 8, 1 and 6, 1 and 4 or 1 and 3. In another embodiment R is a $C_{10}$-$C_{20}$ alkyl group or a $C_{12}$-$C_{18}$ alkyl group and z and y are independently 1 or 2. In yet another embodiment R is a coco alkyl group and z and y are independently 1 or 2. The compound of formula (I) may be coco alkylbis(hydroxyethyl)methyl, ethoxylated, Me sulfates (salts) (CAS No. 68989-03-7), which is commercially available under the following trade names: Ecoeng 500, Ethoquad C 25MS, Rewoquat CPEM, Tego IL-K 5M and Tego IL-K 5MS.

The quaternary fatty amine ethoxylate may be present in the composition in an amount between about 0.1% and about 20% by weight, or in an amount between about 0.1% and about 15% by weight, or in an amount between about 0.1% and about 10% by weight.

Examples of suitable urea salts include acid addition salts, such as for example urea hydrochloride, urea hydrobromide, urea hydroiodide, urea sulfate, urea perchloride, urea nitrate and the like, and combinations thereof.

The urea salt may be present in the composition in an amount between about 1% and about 60% by weight, or in an amount between about 2% and about 50% by weight, or in an amount between about 5% and about 45% by weight.

In some embodiments the composition comprises alkyl esters of one or more soybean oil fatty acids. Typically, the composition comprises alkyl esters of a plurality of soybean oil fatty acids. The major fatty acids present in soybean oil (as triglycerides) are linolenic acid, linoleic acid, oleic acid, stearic acid and palmitic acid. Accordingly, in one embodiment, the composition comprises alkyl esters of linolenic acid, linoleic acid, stearic acid, oleic acid and palmitic acid. The amounts of these esters as a weight percentage of the total amount of soybean oil fatty acid esters in the composition may be as follows:

| Ester type | Amount |
|---|---|
| Linolenic | 5-15% |
| Linoleic | 40-60% |
| Oleic | 20-40% |
| Stearic | 1-8% |
| Palmitic | 5-15% |

The alkyl esters of one or more soybean oil fatty acids may be $C_1$-$C_{20}$ alkyl esters or mixtures thereof, $C_1$-$C_{10}$ alkyl esters or mixtures thereof, $C_1$-$C_6$ alkyl esters or mixtures thereof, $C_1$-$C_4$ alkyl esters or mixtures thereof, or methyl esters.

Soybean oil methyl esters (methyl soyate) are commercially available from Stepan Company, Vertec BioSolvents and Cargill Inc. Those skilled in the art will readily be able to prepare alkyl esters of soybean oil fatty acids by transesterification of soybean oil with an appropriate alcohol, for example methanol.

The alkyl esters of the one or more soybean oil fatty acids may be present in the composition in an amount between about 0.01% and 3% by weight, or in an amount between about 0.01% and 2% by weight, or in an amount between about 0.01% and 1% by weight.

The butoxyethanol may be present in the composition in an amount between about 0.05% and 10% by weight, or in an amount between about 0.1% and 5% by weight, or in an amount between about 0.5% and 5% by weight.

In some embodiments the composition further comprises a thickening agent in an amount effective to modify the viscosity of the composition such that the composition will not flow when applied to a surface. Thickening agents are well known to those skilled in the art. Thickening agents that may be used in the compositions of the invention include, but are not limited to algae extracts, gums, starches, pectins, hydrolysed proteins, cellulose and derivatives thereof, polymers, copolymers, parrafin and clays. Algae extracts that may be used include, but are not limited to alginates and carrageenans. Hydrolysed proteins include, but are not limited to gelatin. Cellulose derivatives that may be used include cellulose ethers such as, for example, methylcellulose, ethylcellulose, hydroxypropylmethylcellulose and hydroxyethylcellulose. Cellulose ethers are commercially available from Dow Chemical under the trade name METHOCEL®.

The amount of thickening agent present in the composition will depend on the particular thickening agent being used. Typically, the thickening agent is present in the composition in an amount between about 0.05% and about 10% by weight, or in an amount between about 0.05% and about 5% by weight, or in an amount between about 0.05% and about 2% by weight, or in an amount between about 0.05% and about 1.5% by weight.

In one embodiment the composition comprises:

(i) a silicate in an amount between about 0.1% and 5% by weight;

(ii) a $C_9$-$C_{11}$ ethoxylated alcohol in an amount between about 0.5% and 20% by weight;

(iii) a quaternary fatty amine ethoxylate in an amount between about 0.1% and 10% by weight;

(iv) a urea salt in an amount between about 2% and 50% by weight; and (v) water in an amount between about 45% and 70% by weight.

In another embodiment the composition comprises:

(i) a silicate in an amount between about 0.1% and 3% by weight;

(ii) a $C_9$-$C_{11}$ ethoxylated alcohol in an amount between about 1.5% and 15% by weight;

(iii) a quaternary fatty amine ethoxylate in an amount between about 0.5% and 10% by weight;

(iv) a urea salt in an amount between about 5% and 45% by weight; and (v) water in an amount between about 45% and 70% by weight.

In yet another embodiment the composition comprises:

(i) a silicate in an amount between about 0.1% and 4% by weight;

(ii) butoxy ethanol in an amount between about 0.1% and 6% by weight;

(iii) alkyl esters of one or more soybean oil fatty acids in an amount between about 0.01% and 1% by weight;

(iv) a $C_9$-$C_{11}$ ethoxylated alcohol in an amount between about 0.5% and 18% by weight;

(v) a quaternary fatty amine ethoxylate in an amount between about 0.1% and 10% by weight;

(vi) a urea salt in an amount between about 2% and 50% by weight; and (vii) water in an amount between about 45% and 70% by weight.

In still a further embodiment the composition comprises:

(i) a silicate in an amount between about 0.3% and 3% by weight;

(ii) butoxy ethanol in an amount between about 0.5% and 5% by weight;

(iii) alkyl esters of one or more soybean oil fatty acids in an amount between about 0.05% and 0.5% by weight;

(iv) a $C_9$-$C_{11}$ ethoxylated alcohol in an amount between about 1% and 15% by weight;

(v) a quaternary fatty amine ethoxylate in an amount between about 0.5% and 10% by weight;

(vi) a urea salt in an amount between about 5% and 45% by weight; and (vii) water in an amount between about 50% and 70% by weight.

In the above embodiments the quaternary fatty amine ethoxylate may be of the formula (I). In the above embodiments the quaternary fatty amine ethoxylate may be coco alkylbis(hydroxyethyl)methyl, ethoxylated, Me sulfates (salts) (CAS No. 68989-03-7).

The compositions may, if desired, comprise additional components and/or additives as long as such components or additives do not adversely affect the properties of the composition.

The compositions may be prepared by mixing the various components according to the weight percentages indicated. Following mixing, a homogeneous solution may be obtained. In some embodiments a mixture comprising the silicate, ethoxylated alcohol and quaternary fatty amine ethoxylate in water may be prepared. The urea salt may then be added and the resulting mixture stirred until a homogenous solution is obtained. In an alternative embodiment a solution of the urea salt in water may be prepared. The silicate, ethoxylated alcohol and quaternary fatty amine ethoxylate may then be added and the resulting mixture stirred until a homogenous solution is obtained. The pH of the composition may be between about 2 and about 8, or between about 3 and about 7, or between about 4 and about 6, or between about 5 and about 6.

Depending on the desired use, the compositions may be used neat or alternatively diluted to any desired concentration. In one embodiment the composition may be drawn from an auxiliary source and metered into water or steam to give the desired dilution at the nozzle. The final concentration at which the composition is used will depend on a variety of factors, such as the mode of application, the temperature of the composition when applied, the dwell time of the composition on the surface, the nature and extent of soiling and the like. In some embodiments the composition is diluted 5 fold or 10 fold with water, applied to the surface for a period of time sufficient to permit cleaning, and then washed off with water. The surface to which the composition has been applied may be agitated prior to the composition being washed off. The dwell time of the composition on the surface will depend on a number of factors, such as the type of surface and the nature and extent of the soiling. Typically, the dwell time will be between about 1 and 30 minutes, and more typically between about 2 and 10 minutes.

The compositions are highly versatile in that they are capable of removing a wide range of soiling from surfaces, for example oil, grease, grime, dirt, bacteria, mould, mildue, bacteria, cement residue, carbon residue, lichen, funghi (such as black spot) and organic stains.

Examples

The invention will now be described in more detail, by way of illustration only, with respect to the following examples. The examples are intended to serve to illustrate this invention and should not be construed as limiting the generality of the disclosure of the description throughout this specification.

In one embodiment, compositions of the invention may be prepared according to the following standard procedure:

1. Ensure mixing vessel is clean.
2. Add formulation quantity of water.
3. Add formulation quantity of silicate.
4. Add formulation quantity of ethoxylated alcohol.
5. Add formulation quantity of quaternary fatty amine ethoxylate.
6. Add formulation quantity of other optional components.
7. Mix the resulting composition.
8. Add formulation quantity of urea salt.
9. Mix until a homogeneous composition is obtained.

The following compositions may be prepared in accordance with the invention. All percentages are w/w.

Composition 1

| | |
|---|---|
| Sodium metasilicate | 3% |
| $C_9$-$C_{11}$ ethoxylated alcohol | 10% |
| coco alkylbis(hydroxyethyl)methyl, ethoxylated, Me sulfates (salts) | 7% |
| Urea HCl | 15% |
| Water | to 100% |

Composition 2

| | |
|---|---|
| Sodium metasilicate | 0.5% |
| $C_9$-$C_{11}$ ethoxylated alcohol | 1.5% |
| coco alkylbis(hydroxyethyl)methyl, ethoxylated, Me sulfates (salts) | 1% |
| Urea HCl | 45% |
| Water | to 100% |

Composition 3

| | |
|---|---|
| Sodium metasilicate | 2% |
| $C_9$-$C_{11}$ ethoxylated alcohol | 7.5% |
| coco alkylbis(hydroxyethyl)methyl, ethoxylated, Me sulfates (salts) | 4.5% |
| Urea HCl | 25% |
| Water | to 100% |

Composition 4

| | |
|---|---|
| Sodium metasilicate | 3% |
| $C_9$-$C_{11}$ ethoxylated alcohol | 12% |
| coco alkylbis(hydroxyethyl)methyl, ethoxylated, Me sulfates (salts) | 7% |
| Urea HCl | 5% |
| Water | to 100% |

Composition 5

| | |
|---|---|
| Sodium metasilicate | 2.1% |
| Butoxy ethanol | 3.5% |
| Methyl soyate | 0.35% |
| $C_9$-$C_{11}$ ethoxylated alcohol | 10.5% |
| coco alkylbis(hydroxyethyl)methyl, ethoxylated, Me sulfates (salts) | 6.3% |
| Urea HCl | 15% |
| Water | to 100% |

Composition 6

| | |
|---|---|
| Sodium metasilicate | 0.3% |
| Butoxy ethanol | 0.5% |
| Methyl soyate | 0.05% |
| $C_9$-$C_{11}$ ethoxylated alcohol | 1.5% |
| coco alkylbis(hydroxyethyl)methyl, ethoxylated, Me sulfates (salts) | 0.9% |
| Urea HCl | 45% |
| Water | to 100% |

Composition 7

| | |
|---|---|
| Sodium metasilicate | 1.5% |
| Butoxy ethanol | 2.5% |
| Methyl soyate | 0.25% |
| $C_9$-$C_{11}$ ethoxylated alcohol | 7.5% |
| coco alkylbis(hydroxyethyl)methyl, ethoxylated, Me sulfates (salts) | 4.5% |
| Urea HCl | 25% |
| Water | to 100% |

Composition 8

| | |
|---|---|
| Sodium metasilicate | 2.7% |
| Butoxy ethanol | 4.5% |
| Methyl soyate | 0.45% |
| $C_9$-$C_{11}$ ethoxylated alcohol | 13.5% |
| coco alkylbis(hydroxyethyl)methyl, ethoxylated, Me sulfates (salts) | 8.1% |
| Urea HCl | 5% |
| Water | to 100% |

Use of Compositions to Clean Various Surfaces

Figure 5:
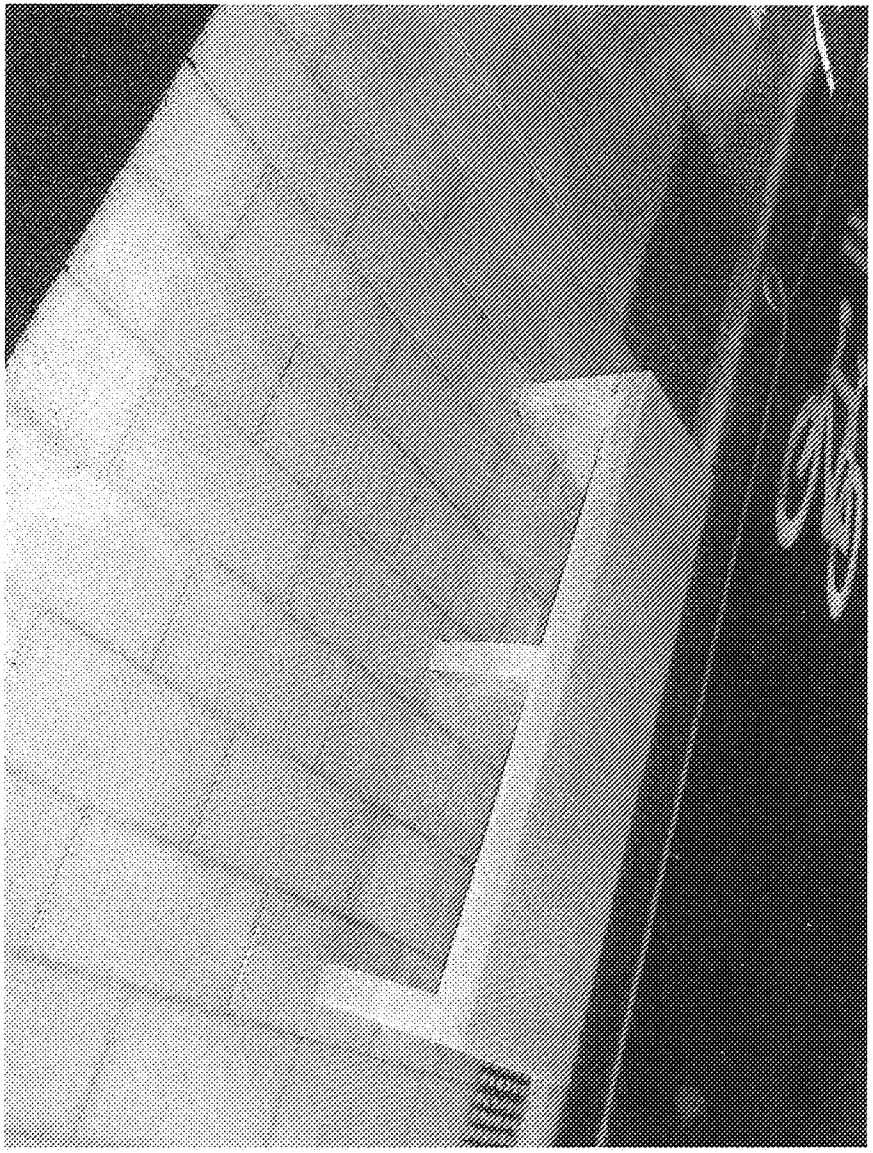
Figure 6:
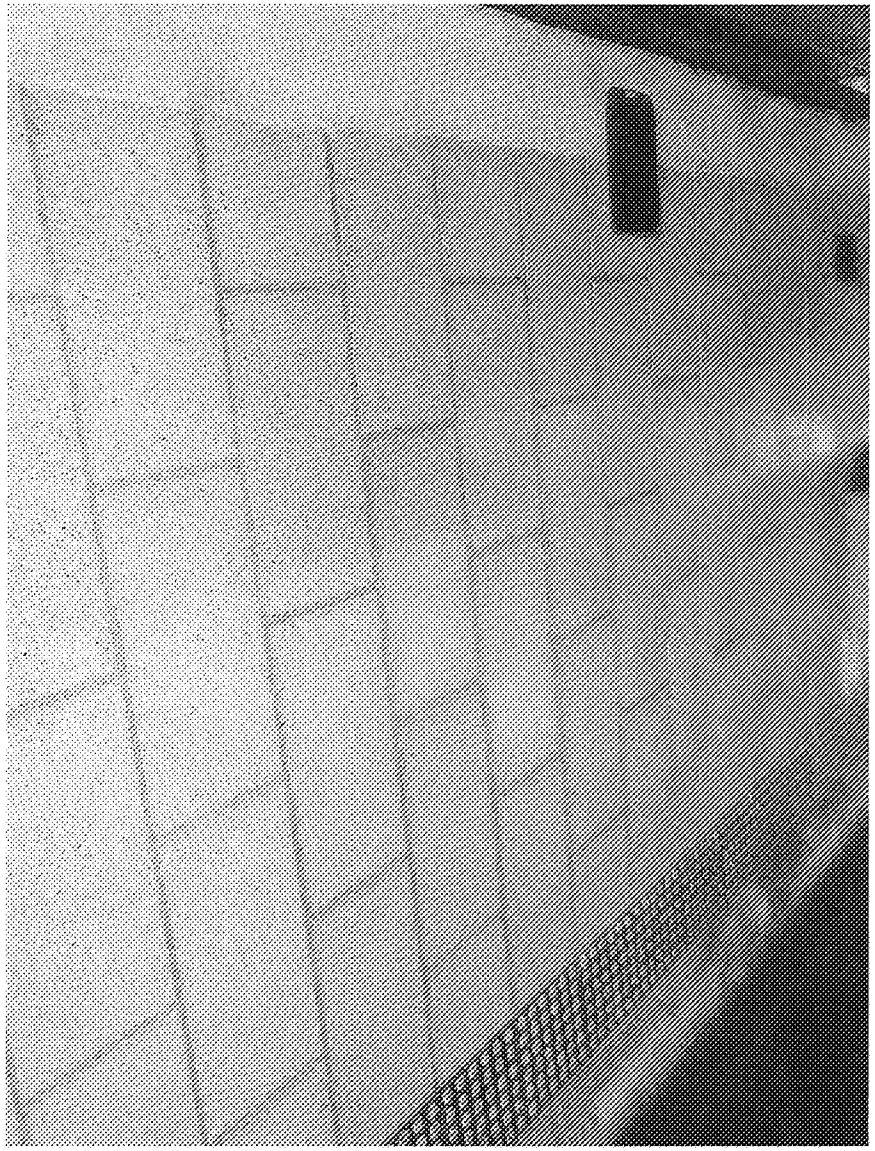
Figure 7:
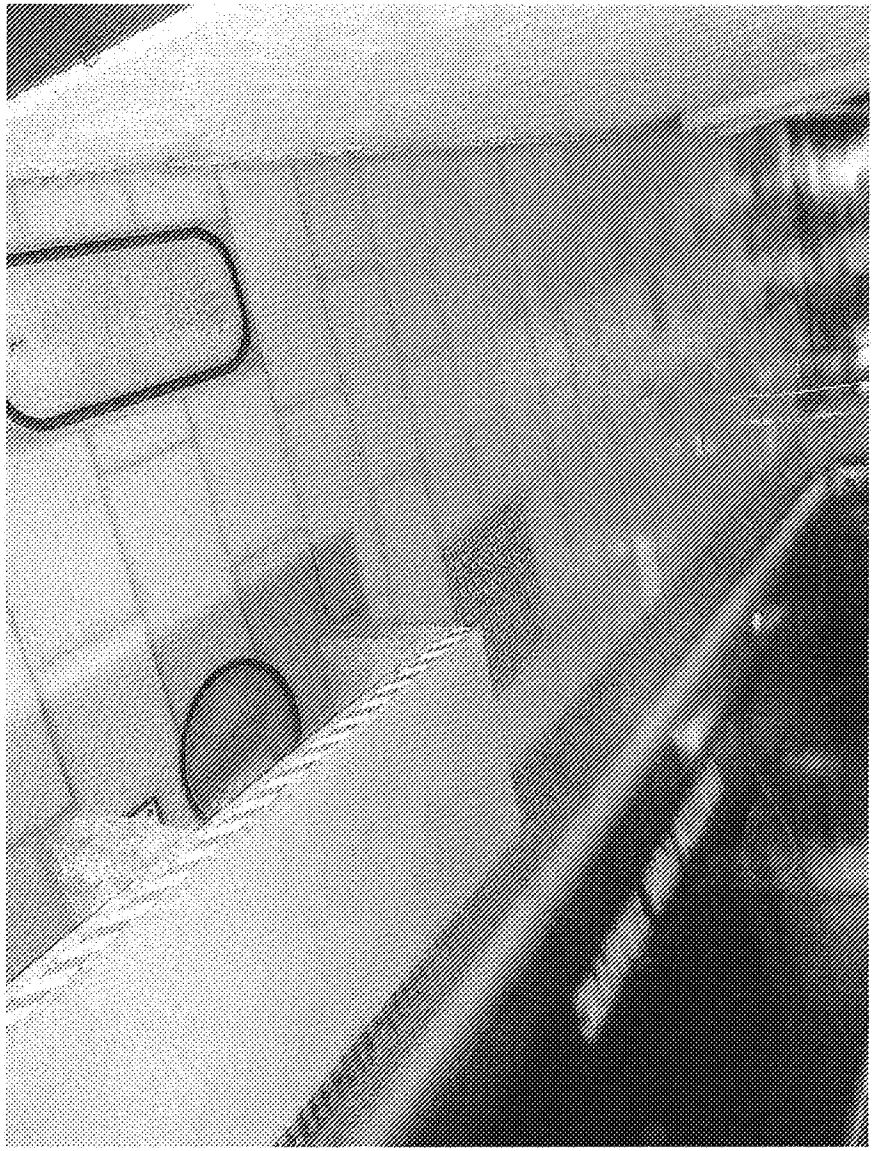

Composition 5 was applied to stained and dirty pavers. Following a hot water wash, the pavers came up like new. FIGS. 1 to 4 show the state of the pavers before application of the composition and FIGS. 5 to 7 show the state of the pavers after cleaning with the composition.

Composition 7 was applied to a concrete slab covered with grease, oil, transmission fluid and other unknown stains. Following application the slab was scrubbed. About 15 minutes after scrubbing was stopped the slab was rinsed with pressurized hot water resulting in all stains being removed.

Composition 6 was sprayed over roof tiles that were contaminated with cement grouting residue and mould. After a dwell time of about 10 minutes the composition was rinsed off with tap water from a hose. All mould and cement grouting residue was removed.

Composition 8 was sprayed onto metal industrial bins contaminated with food residue, grease and oil. Following slight agitation and a dwell time of about 10 minutes the composition was rinsed off. The bins were completely cleaned.

Composition 6 was applied to a cement truck contamined with cement residue and road grime. The composition was sprayed onto the truck and allowed to sit for about 10-15 minutes. Following washing, the residue and grime was successfully removed with no damage to the truck.

Composition 5 was applied to sandstone pavers contaminated with lichen and black spot. Following agitation and a dwell time of 10-15 minutes the composition was rinsed off with pressurized cold water. The lichen and black spot were successfully removed.

The reference in this specification to any prior publication (or information derived from it), or to any matter which is known, is not, and should not be taken as an acknowledgement or admission or any form of suggestion that that prior publication (or information derived from it) or known matter forms part of the common general knowledge in the field of endeavor to which this specification relates.

It will be appreciated by those skilled in the art that numerous variations and/or modifications may be made to the invention without departing from the spirit or scope of the invention as broadly described. The present embodiments are therefore to be considered in all respects as illustrative and not restrictive.

The invention claimed is:

1. A water-based cleaning composition comprising:
(i) a silicate;
(ii) an ethoxylated alcohol;
(iii) a quaternary fatty amine ethoxylate;
(iv) a urea salt; and
(v) butoxyethanol in an amount between about 0.05% and 10% by weight.

2. The composition of claim 1 , wherein the silicate is present in the composition in an amount between about 0.05% and about 10% by weight.

3. The composition of claim 1, wherein the ethoxylated alcohol is present in the composition in an amount between about 0.5% and about 20% by weight.

4. The composition of claim 1, wherein the quaternary fatty amine ethoxylate is present in the composition in an amount between about 0.1% and about 20% by weight.

5. The composition of claim 1, wherein the urea salt is present in the composition in an amount between about 1% and about 60% by weight.

6. The composition of claim 1, wherein water is present in the composition in an amount between about 30% and about 70% by weight.

7. The composition of claim 1, wherein the silicate is an alkali metal silicate.

8. The composition of claim 1, wherein the ethoxylated alcohol is a $C_9$-$C_{11}$ ethoxylated alcohol.

9. The composition of claim 8, wherein the $C_9$-$C_{11}$ ethoxylated alcohol has an average of about 2 to 10 moles of ethylene oxide per mole of alcohol.

10. The composition of claim 1, wherein the quaternary fatty amine ethoxylate has the following general formula (I):

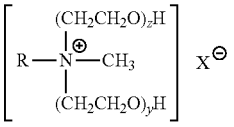

(I)

wherein:
R is a $C_4$-$C_{24}$ alkyl group;
z and y are independently selected from an integer between 1 and 20; and
X is a counter ion.

11. The composition of claim 10, wherein:
R is a $C_{10}$-$C_{20}$ alkyl group;
z and y are independently selected from an integer between 1 and 10, 1 and 8, 1 and 6 or 1 and 4; and
X is a counter ion.

12. The composition of claim 1, further comprising alkyl esters of one or more soybean oil fatty acids.

13. The composition of claim 12, wherein the alkyl esters of the one or more soybean oil fatty acids are $C_1$-$C_{20}$ alkyl esters or mixtures thereof, $C_1$-$C_{10}$ alkyl esters or mixtures thereof, $C_1$-$C_4$ alkyl esters or mixtures thereof, or methyl esters.

14. The composition of claim 12, wherein the alkyl esters of the one or more soybean oil fatty acids are present in the composition in an amount between about 0.01% and 3% by weight.

15. A method for cleaning a soiled surface comprising:
contacting the soiled surface with the composition of claim 1, and rinsing the surface with water.

16. The method of claim 15, further comprising agitating the surface to which the composition has been applied.

* * * * *